US007669290B2

(12) United States Patent
Oddo et al.

(10) Patent No.: US 7,669,290 B2
(45) Date of Patent: Mar. 2, 2010

(54) ANTI-VIBRATORY HANDLE FOR PERCUSSIVE AND OTHER RECIPROCATING TOOLS

(75) Inventors: Remy Oddo, Sherbrooke (CA); Christian Clavet, Sherbrooke (CA); Gilles LeBlanc, Sullivan (CA); Sylvain Ouellette, Sullivan (CA); Alan John Marsden, Burlington (CA); William Dale Quesnel, Burlington (CA)

(73) Assignees: Universite de Sherbrooke, Quebec (CA); Her Majesty the Queen in right of Canada, as represented by the Minister of Natural Resources, Ontario (CA)

( * ) Notice: Subject to any disclaimer, the term of this patent is extended or adjusted under 35 U.S.C. 154(b) by 105 days.

(21) Appl. No.: 11/543,700

(22) Filed: Oct. 4, 2006

(65) Prior Publication Data

US 2007/0107165 A1 May 17, 2007

Related U.S. Application Data

(63) Continuation-in-part of application No. 10/804,344, filed on Mar. 19, 2004, now abandoned.

(30) Foreign Application Priority Data

Mar. 19, 2003 (CA) ..... 2423282

(51) Int. Cl.
*B25G 1/10* (2006.01)

(52) U.S. Cl. ..... 16/431; 173/162.1; 173/168

(58) Field of Classification Search ..... 16/294, 16/404, 430, 431, 436; 30/381–387, 514, 30/517–519; 173/162.1, 162.2, 168–170; 267/136, 137, 140.13
See application file for complete search history.

(56) References Cited

U.S. PATENT DOCUMENTS 1,945,430 A * 1/1934 Garrett ..... 403/66

(Continued)

OTHER PUBLICATIONS

T. Miwa, "Studies on hand protectors for portable vibrating tools", Industrial Health, vol. 2, 1964, pp. 95-105.

(Continued)

*Primary Examiner*—Victor Batson
*Assistant Examiner*—Roberta Delisle
(74) *Attorney, Agent, or Firm*—Fay Kaplun & Marcin, LLP

(57) ABSTRACT

Described is an anti-vibratory handle for installation on a reciprocating tool supplied with a pressurized fluid and producing vibrations in the direction of an axis of reciprocation of the tool. The anti-vibratory handle comprises a stationary portion mounted to a body of the tool, a mobile portion comprising a hand-grip member and an articulation between the stationary and mobile portions. This articulation comprises a pivot assembly interconnecting the stationary and mobile portions, the pivot assembly defines a pivot axis substantially perpendicular to the tool reciprocation axis, and the hand-grip member of the mobile portion is spaced apart from both the pivot axis and the tool reciprocation axis. The articulation also comprises a resilient vibration-damping assembly interposed between the stationary and mobile portions to avoid transmission of vibrations through the articulation. At least one conduit extends through the mobile portion, the articulation and the stationary portion to supply pressurized fluid to the tool.

12 Claims, 8 Drawing Sheets

U.S. PATENT DOCUMENTS

| | | | | | |
|---|---|---|---|---|---|
| 2,058,583 | A | * | 10/1936 | Forss | 173/162.2 |
| 2,182,565 | A | * | 12/1939 | Lofgren | 16/405 |
| 2,353,450 | A | * | 7/1944 | Fischer | 72/312 |
| 2,365,536 | A | * | 12/1944 | Fischer et al. | 60/540 |
| 2,478,784 | A | * | 8/1949 | Serio | 294/31.1 |
| 2,629,364 | A | | 2/1953 | Anderson | |
| 2,718,406 | A | * | 9/1955 | Sawyer et al. | 280/646 |
| 2,985,078 | A | * | 5/1961 | Leavell | 173/162.1 |
| 3,028,840 | A | | 4/1962 | Leavell | |
| 3,248,974 | A | * | 5/1966 | Alexander et al. | 408/130 |
| 3,326,304 | A | * | 6/1967 | Johnson | 173/169 |
| 3,571,874 | A | * | 3/1971 | Von Arz | 29/81.14 |
| 3,923,126 | A | * | 12/1975 | Bidanset | 188/77 W |
| 3,968,843 | A | * | 7/1976 | Shotwell | 173/210 |
| 4,036,085 | A | * | 7/1977 | Sjostrand et al. | 81/464 |
| 4,248,441 | A | * | 2/1981 | Joseph | 280/33.992 |
| 4,368,556 | A | * | 1/1983 | Wanner et al. | 16/436 |
| 4,478,293 | A | * | 10/1984 | Weilenmann et al. | 173/162.2 |
| 4,522,270 | A | * | 6/1985 | Kishi | 173/217 |
| 4,592,109 | A | * | 6/1986 | Borea et al. | 15/172 |
| 4,609,055 | A | * | 9/1986 | Grafstrom et al. | 173/162.2 |
| 4,648,468 | A | * | 3/1987 | Honsa | 173/210 |
| 4,667,749 | A | * | 5/1987 | Keller | 173/162.2 |
| 4,670,985 | A | | 6/1987 | Biersteker | |
| 4,771,833 | A | * | 9/1988 | Honsa | 173/162.2 |
| 4,883,211 | A | * | 11/1989 | Philipp et al. | 227/9 |
| 4,912,349 | A | * | 3/1990 | Chang | 310/50 |
| 5,016,355 | A | | 5/1991 | Gassen et al. | |
| 5,025,870 | A | * | 6/1991 | Gantner | 173/162.2 |
| 5,054,562 | A | * | 10/1991 | Honsa et al. | 173/210 |
| 5,065,476 | A | * | 11/1991 | Dohse et al. | 16/426 |
| 5,273,120 | A | * | 12/1993 | Chang | 173/162.2 |
| 5,405,216 | A | * | 4/1995 | Allen et al. | 404/112 |
| 5,442,992 | A | * | 8/1995 | Sanner et al. | 91/428 |
| 5,533,579 | A | * | 7/1996 | Chu | 173/17 |
| 5,626,199 | A | * | 5/1997 | Henry et al. | 173/211 |
| 5,653,370 | A | * | 8/1997 | Bereiter et al. | 227/10 |
| 5,727,829 | A | | 3/1998 | Bellichak | |
| 5,839,517 | A | * | 11/1998 | Gwinn et al. | 173/162.2 |
| 5,845,364 | A | * | 12/1998 | Chen | 16/436 |
| 5,898,980 | A | * | 5/1999 | Havranek et al. | 27/27 |
| 5,911,263 | A | * | 6/1999 | Wu | 16/429 |
| 5,927,407 | A | * | 7/1999 | Gwinn et al. | 173/162.2 |
| 6,026,910 | A | * | 2/2000 | Masterson et al. | 173/162.2 |
| 6,076,616 | A | * | 6/2000 | Kramp et al. | 173/162.2 |
| 6,145,899 | A | * | 11/2000 | Kelemen | 294/57 |
| 6,155,354 | A | * | 12/2000 | Pusateri et al. | 173/170 |
| 6,189,420 | B1 | * | 2/2001 | Shiao | 81/60 |
| 6,216,317 | B1 | * | 4/2001 | Chen | 16/430 |
| 6,317,930 | B1 | * | 11/2001 | Hung | 16/430 |
| 6,339,979 | B1 | * | 1/2002 | Chiang | 81/177.2 |
| 6,386,075 | B1 | | 5/2002 | Shiao | |
| 6,397,436 | B1 | | 6/2002 | Wang | |
| 6,421,880 | B1 | | 7/2002 | Prajapati et al. | |
| 6,467,130 | B2 | | 10/2002 | Kurachi et al. | |
| 6,557,212 | B2 | * | 5/2003 | Huang | 16/430 |
| 6,837,415 | B1 | | 1/2005 | Huang | |
| 2001/0034940 | A1 | * | 11/2001 | Marshall et al. | 30/276 |
| 2002/0020042 | A1 | * | 2/2002 | Kurachi et al. | 16/438 |
| 2005/0050690 | A1 | | 3/2005 | Oddo et al. | |

OTHER PUBLICATIONS

T. Miwa, "Studies on hand protectors for portable vibrating tools", Industrial Health, vol. 2, 1964, pp. 106-123.

T. Miwa et al., "Vibration Isolators for Portable Vibrating Tools", Industrial Health, vol. 17, 1979, pp. 141-152.

S. Villon, "Effect of Gloves on the Transmission of Vibration to the Hand", M. Sc. Dissertation, University of Southampton, 1982, 4 sheets.

N. Paran'ko, "Hygienic Evaluation of Vibration and Noise Damping Devices for Hand-operated Pneumatic Rock Drills", Pat. Fiziol, vol. 4, 1964, pp. 29-34.

P. Boileau, "Les Vibrations Engendrees Par Les Foreuses a Bequille a la Division Opemiska de Minnova", Rapport IRSST B-027, Dec. 1990, pp. 1-43.

K. Prajapati et al., "Reduction of Hand-arm Transmitted Vibration on Pneumatic Jackleg Rock Drills", Congres CIM, Sudburry, 7 sheets.

N. Shaikh at al, "Design of a Quiet Rock Drill, a Feasibility Study Using Principle of Leavell Paving Breaker", Jun. 1977, Vast Research Co., Contract U.S. Bureau of Mines, pp. 39.

N. Billette, "Vibrations de Foreuses Pneumatiques de Mines, Essais Recensès de Contrôle/Èlimination", May 1993, Rapport Interned CANMET 1 sheet.

P. Voss, "United Kingdom Informal Group on Human Response to Vibration, On the Vibration Isolating Efficiency of Gloves" Sep. 16-17, 1982, 8 sheets.

* cited by examiner

ANTI-VIBRATORY HANDLE FOR PERCUSSIVE AND OTHER RECIPROCATING TOOLS

PRIORITY CLAIM

This application claims the benefit of and is a Continuation-In-Part of U.S. patent application Ser. No. 10/804,344 filed on Mar. 19, 2004 now abandoned which claims priority to CA Patent Application Serial No. 2,423,282 filed on Mar. 19, 2003; specifications of both applications are expressly incorporated herein, in their entirety, by reference

FIELD OF THE INVENTION

The present invention relates to an anti-vibratory handle for tools producing vibrations, in particular but not exclusively percussive and other reciprocating tools. In operation, this anti-vibratory handle reduces transmission of vibrations from the tool to the hand(s) and upper limb(s) of the operator.

BACKGROUND OF THE INVENTION

Protection of Hand

Various studies have been conducted on the effectiveness of anti-vibratory gloves:

Miwa, T; "Studies on hand protectors for portable vibrating tools, I. Measurements of the attenuation effect of porous elastic materials"; Industrial Health, 2, 95-105; 1964;

Miwa, T; "Studies on hand protectors for portable vibrating tools, II. Simulation of porous elastic materials and their application to hand protectors"; Industrial Health, 2, 106-123; 1964;

Miwa, T; Yoneska, Y; et Kanada, K; "Vibration isolators for portable vibrating tools, Part 4. Vibration isolation gloves"; Industrial Health, 17, 141-152; 1979;

Saunders, R. L.; "Report on the testing of anti-vibration gloves"; B. C. Research, 4 pages; 1978;

Voss, P.; "On the vibration isolating efficiency of gloves"; United Kingdom Informal Group on Human Response to Vibration, September 16-17, Paper 3.1, 9 pages; 1982; and Villon, S. J.; "Effect of gloves on the transmission of vibration to the hand"; M. Sc. Dissertation, University of Southampton, 140 pages, 1982.

All of these studies have demonstrated the effectiveness of such gloves for frequencies above the 100-140 Hz range, depending on the individual wearer. Below this range, however, anti-vibratory gloves are at best ineffective or tend to enhance vibrations transmitted to the hands (at resonance frequencies ranging from 30 to 45 Hz, depending on the type of glove and on the morphology of the palm of the worker).

In the particular context of percussion drills, with a dominant frequency corresponding to the frequency of impact (about 40 Hz), this type of glove may increase the exposure of workers to vibrations.

It should be noted nevertheless, that wearing gloves prevents direct contact of the hands with cold surfaces. This is a very positive factor that may limit the appearance of symptoms related to Raynaud's syndrome. The Raynaud's syndrome is well known to those of ordinary skill in the art and, therefore, will not be further described in the present specification.

Modification of the Handle

Numerous investigations have been conducted for the purpose of damping or insulating vibrations at the level of the handle or between the body of the percussion drill and the handle.

Among the most significant works, a Russian study in 1964 may be cited, which deals with the development of anti-vibratory handles [Paran'ko, N. M.; "Hygienic evaluation of vibration and noise damping devices for hand-operated pneumatic rock drills"; Pat. Fiziol., 4, 32-38; 1964]. Prototypes of handles developed in the context of this study showed effectiveness approaching a 50% reduction of vibrations, but in association with either too great an increase in weight or poor mechanical resistance.

A patent was granted to Shotwell in 1976 for an anti-vibratory handle for a portable pneumatic hammer [Shotwell D. B.; "Pneumatic percussion tool having a vibration dampened handle". Caterpillar Tractor Co.; U.S. Pat. No. 3,968,843 issued on Jul. 13, 1976]. The invention described in U.S. Pat. No. 3,968,843 consists of a rubber element inserted between the handle and the body of the pneumatic hammer. According to this patent, an attenuation of vibrations at the frequencies of interest of the order of 17 dB may be obtained. However, no statement is made about the durability or ease of handling of the tool.

Aside from the above studies, those of Boileau [Boileau P. É.; "Les vibrations engendrées par les foreuses à béquille à la division Opémiska de Minnova"; Rapport IRSST B-027, Décembre 1990] tested and compared two anti-vibratory handles. One of these handles was, among other things, homemade and equipped with a resilient member placed between the handle and the body of a percussion drill. And this handle provided an attenuation of the order of 20% of the vibrations transmitted to the worker.

More recently, a study conducted in 1998 by the firm Boart Longyear Inc. led to the development of a new handle [Prajapati K., Hes P.; "Reduction of hand-arm transmitted Vibration on Pneumatic Jackleg Rock Drills", Congrès CIM, Sudbury]. Tests showed an approximately 50% attenuation of non-weighted vibration levels. This attenuation is due primarily to a decrease of high frequency (>640 Hz) vibrations. The presented spectra fail to show any attenuation at the frequency of impact defined by Boileau [Boileau P. É.; "Les vibrations engendrées par les foreuses à béquille à la division Opémiska de Minnova"; Rapport IRSST B-027, Décembre 1990], among others, as the principal component of the weighted spectrum. The impact of the use of such a handle on the exposure of workers to vibrations thus remains minimal.

Prior Works Applied to Other Tools

Numerous studies have been conducted with the aim of reducing vibrations transmitted from chainsaws to the hands of the operators. The concept most generally used is uncoupling the chain guard and the saw handle from the moving mechanical parts (internal combustion engine and chain drive system) [Bierstecker, M.; "Vibration mount on a chainsaw"; U.S. Pat. No. 4,670,985 issued Jun. 9, 1987] [Gassen J. R.; Suchdev L. S.; "Vibration Reducing Chainsaw Handle", U.S. Pat. No. 5,016,355 issued May 21, 1991]. Recent machines equipped with this type of suspension have greatly reduced the exposure of forestry workers to vibrations.

Various other studies have been conducted on concrete breakers. Although the source of vibrations in concrete breakers is very similar to that observed in air-leg percussion drills, the modes of operation of the two tools are quite different. The operator must hold continuously the concrete breaker using both hands and the direction of the work is generally vertical. Also, gripping of the concrete breaker differs greatly from gripping of the air-leg percussion drill, which is used essentially for making horizontal holes. In air-leg percussion drills, the drive force is produced essentially by the air-leg and the miner intervenes mainly to make the pilot hole necessary to keep the machine on the desired axis. The solutions developed within the context of these studies are therefore not directly applicable to percussion drills. One type of solution that may be cited is the development of flexible hoop-type handles or the installation of dynamic absorbers [IRGO-Pic™, Ingersoll-Rand™].

SUMMARY OF THE INVENTION

The present invention relates to an anti-vibratory handle for installation on a reciprocating tool supplied with a pressurized fluid and producing vibrations in the direction of an axis of reciprocation of the tool, comprising:

a stationary portion mounted to a body of the tool;

a mobile portion comprising a hand-grip member; and an articulation between the stationary and mobile portions, the articulation comprising:

a pivot assembly interconnecting the stationary and mobile portions, wherein the pivot assembly defines a pivot axis substantially perpendicular to the tool reciprocation axis, and the hand-grip member of the mobile portion is spaced apart from both the pivot axis and the tool reciprocation axis; and a resilient vibration-damping assembly interposed between the stationary and mobile portions to avoid transmission of vibrations through the articulation; and at least one conduit for supplying pressurized fluid to the reciprocating tool, the at least one conduit extending through the mobile portion, the articulation and the stationary portion.

The foregoing and other objects, advantages and features of the present invention will become more apparent upon reading of the following non-restrictive description of illustrative embodiments thereof, given by way of example only with reference to the accompanying drawings.

DETAILED DESCRIPTION

The development of an anti-vibratory handle for tools producing vibrations, such as percussive and other reciprocating tools, may be expressed in terms of three challenges:

to develop an anti-vibratory handle effective at low frequencies (about 30 Hz), therefore involving large reciprocating movements;

to ensure the passage of the tool control (electrical, pneumatic or hydraulic control) through a suspension; and to design a system both simple and robust for use under extremely severe operating conditions, for example in underground mines.

Figure 1:
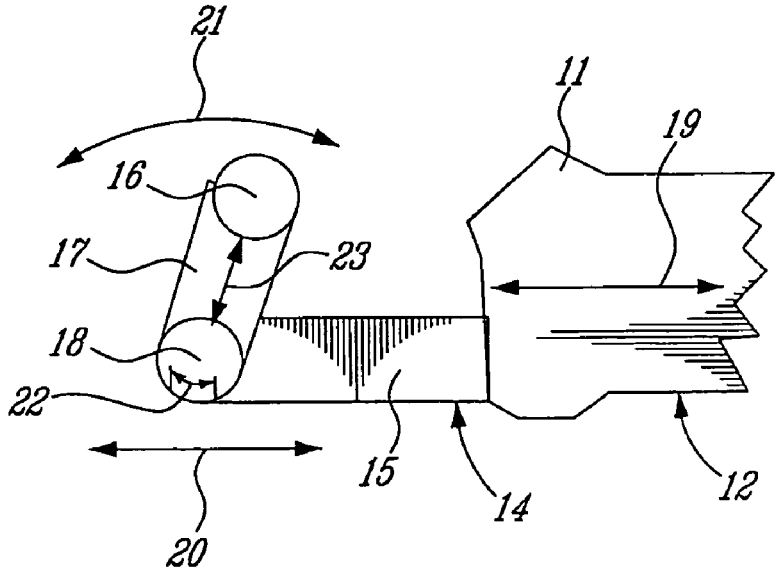
FIG. 1 is a schematic illustration of the basic concept of a first non-restrictive illustrative embodiment of the anti-vibratory handle according to the present invention.

FIG. 1 illustrates the basic concept of the first illustrative embodiment of the anti-vibratory handle according to the present invention, consisting of installing a pivot spaced apart from but parallel to the point of gripping of the handle.

More specifically, FIG. 1 illustrates the body 11 of a percussion drill 12. This percussion drill 12 is provided with an anti-vibratory handle 14 according to the first illustrative embodiment of the present invention.

Although the non-restrictive illustrative embodiments of the present invention will be described in relation to a percussion drill, is should be kept in mind that the present invention can be applied to other types of tools producing vibrations, in particular but not exclusively percussive and other reciprocating tools.

In accordance with the first non-restrictive illustrative embodiment, the anti-vibratory handle 14 comprises at least one arm member 15 having a proximal end connected to the body 11. The anti-vibratory handle 14 also comprises a hand-grip member 16 connected to the distal end of the arm member 15 through at least one arm member 17 and an articulation 18 comprising a pivot (not shown).

Still referring to FIG. 1, the double arrows 19, 20, 21, 22 and 23 represent the nature, direction and amplitude of the main vibrations to which a percussion drill is subjected.

The double arrows 19 and 20 illustrate the vibrations of the body 11 of the drill 12 along the axis of percussion. As can be seen in FIG. 1, the hand-grip member 16 and the pivot of the articulation 18 are parallel to each other but perpendicular to the axis of percussion (see double arrows 19 and 20). According to the first non-restrictive illustrative embodiment, the arm member 17, when non operating, defines with the arm member 15 an acute angle slightly lower than 90° about the articulation 18, of the order of, for example, 75°.

Under the influence of the back-and-forth movement (see double arrow 19 and 20 of FIG. 1) of the drill 12 along the axis of percussion, the handle 14 pivots about the articulation 18 (see double arrow 22) whereby the hand-grip member 16 moves along an arc of a circle (see double arrow 21) having a radius equivalent to the distance separating the axis of the pivot of the articulation 18 and the axis or center of inertia of the hand-grip member 16 bearing the hand(s) of the worker.

Although the attenuation of the vibrations along the axis of percussion (see double arrows 19 and 20) will produce a slight increase in vibratory movement along the longitudinal axis of the arm member 17 (see double arrow 23), the rotary concept of the anti-vibratory handle 14 affords major advantages in terms of design simplicity. In fact, it is relatively easy to obtain pure rotation. This type of movement can be achieved by means of a simple pivot supported by self-lubricating bearings. There are numerous low-cost, commercially available products for producing pure rotation.

Vibratory insulation is obtained by means of resilient members (not shown in FIG. 1) inserted within the articulation 18. These resilient members can comprise torsion insulators or pieces of resilient material inserted between jaws formed between mobile (hand-grip member 16 and arm member 17) and stationary (arm member 15) parts of the articulation 18 to avoid transmission of vibrations through the articulation 18.

For pneumatic percussion drills, the angular movement of the hand-grip member 16 about the articulation 18 (see double arrows 21 and 22) will remain small; for example, an angular movement of ±5° (see double arrows 21 and 22) can be used for an axial displacement (see double arrow 20) of the anti-vibratory handle 14 handle of about 2 cm. With such a small angular movement, pneumatic connections under the form of flexible plastic tubes could be used without onset of material fatigue, even after a large number of bending cycles. In this manner, no complex air-tight connections are required and the structure of the articulation is thus greatly simplified to substantially reduce the costs.

Figure 2:
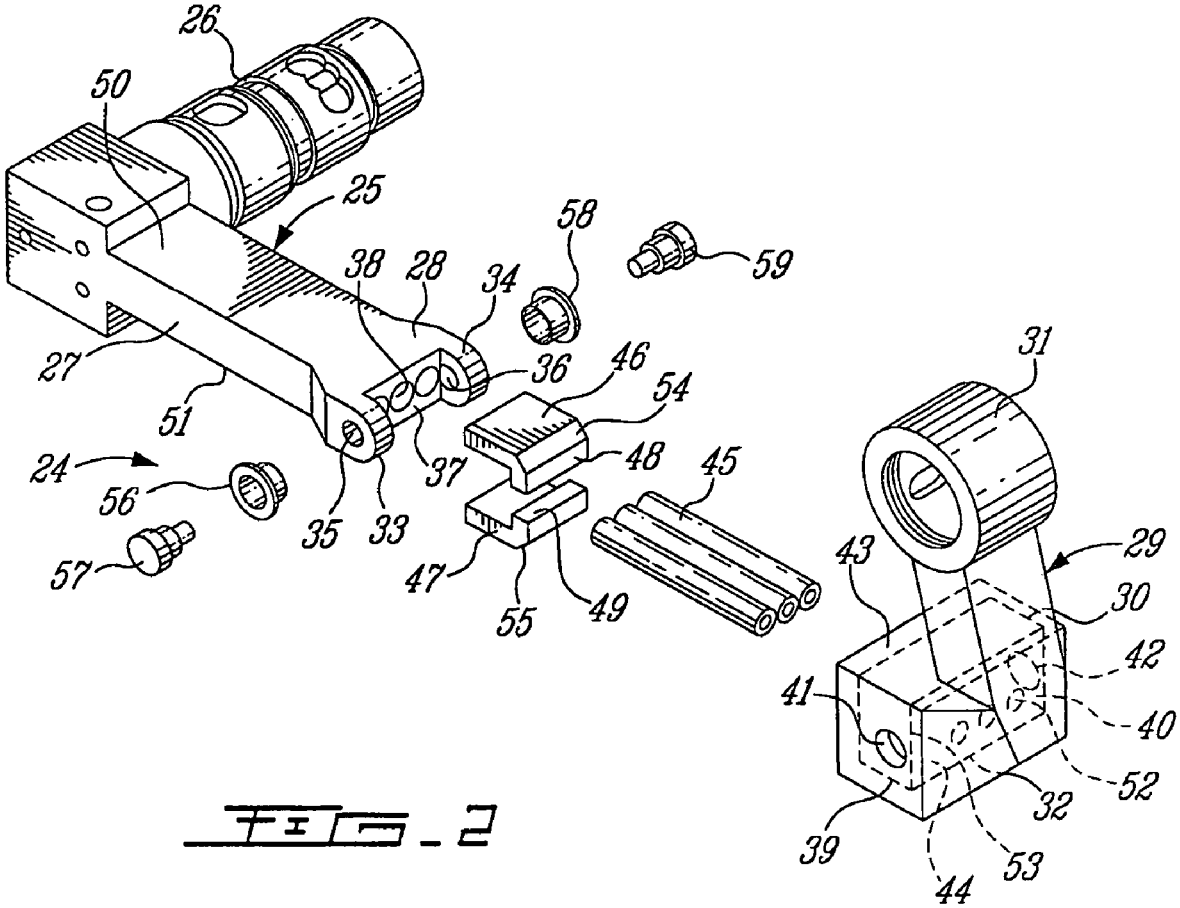
FIG. 2 is an exploded view of an anti-vibratory handle according to the first non-restrictive illustrative embodiment according to the present invention, adapted for a JOY™ percussion drill.

FIG. 2 is an exploded view of an anti-vibratory handle according to the first illustrative embodiment of the present invention, adapted for a JOY™ percussion drill. The anti-vibratory handle of FIG. 2 is generally identified by the reference 24.

The anti-vibratory handle 24 includes a stationary portion 25 integrated to the percussion drill (not shown) via a fixation cone 26 of the same type as those used for mounting conventional handles. Fixedly connected perpendicular to the fixation cone 26 is an arm member 27 extending in the direction of the axis of percussion. The arm member 27 comprises a pairs of opposite, longitudinal top and bottom flat faces 50 and 51. The distal end 28 of the arm member 27 forms part of the articulation 18 (FIG. 1).

The anti-vibratory handle 24 also includes a mobile portion 29 comprising an arm member 30. The distal end of the arm member 30 is formed with a conical attachment device 31 of the type providing for direct attachment of a conventional hand-grip member (not shown) including controls for the operation of the percussion drill. This conventional hand-grip member may be identical in all respects to the existing JOY™ handle. The proximal end 32 of the arm member 30 also forms part of the articulation 18 (FIG. 1). When the tool is not operating, the arm member 30 will be advantageously inclined in such a manner that the imaginary line extending between the geometrical axis of the conical attachment device 31 and the pivot axis (axis of the holes 41 and 42) forms an angle of 90° with the percussive axis (tool reciprocation axis) of the percussion drill.

The distal end 28 of the arm member 27 is formed with two parallel side ears 33 and 34 with respective coaxial threaded holes 35 and 36. The distal end 28 further comprises, between the ears 33 and 34, a flat face 37 perpendicular to the longitudinal axis of the arm member 27. A series of three axial holes such as 38 are provided through the flat face 37 between the two ears 33 and 34. These axial holes 38 are in communication with pressurized air transmitting conduits formed through the arm member 27.

The proximal end 32 of the arm member 30 has the general configuration of a hollow rectangular box-like structure with a face open toward the distal end 28 of the arm member 27. The rectangular box-like structure comprises:

- a pair of opposite side walls 39 and 40 formed with respective coaxial holes 41 and 42;
- a second pair of opposite top and bottom walls 43 and 44; and
- an internal end wall 53 formed with a series of three holes 52 opposite to but corresponding to the series of three holes 38.

Again, these holes 52 are in communication with pressurized air transmitting conduits formed through the arm member 30.

The articulation 18 between the arm members 27 and 30 finally comprises three flexible tubes such as 45 of equal length and two generally flat resilient members 46 and 47 L-shaped in cross section to define respective shoulders 48 and 49. For example, the tubes 45 can be made of plastic material and the resilient members 46 and 47 made of elastomeric material.

During installation, the following operations are performed:

- the three flexible tubes 45 comprise respective first ends respectively inserted into the three holes 38, the first ends of the three flexible tubes 45 snugly fitting into the respective three holes 38;
- the resilient member 46 is applied to the top flat face 50 of the arm member 27 with the shoulder 48 applied to the end flat face 37;
- the resilient member 47 is applied to the bottom flat face 51 of the arm member 27 with the shoulder 49 applied to the end flat face 37;
- the rectangular box-like structure of the proximal end 32 of the arm member 30 is positioned over the distal end 28 of the arm member 27, more specifically over the ears 33 and 34 and the resilient members 46 and 47. The resilient members are beveled at 54 and 55 to facilitate this operation. The three flexible tubes 45 comprise respective second ends respectively inserted, during this operation, into the three holes 52, the second ends of the three flexible tubes 45 snugly fitting into the respective three holes 52; and
- to complete the assembly, a bushing 56 made of any suitable attrition-resistant material such as bronze is inserted in hole 41, and a shoulder screw 57 is driven into the threaded hole 35 through the bushing 56. In the same manner, a bushing 58 made of any suitable attrition-resistant material such as bronze is inserted in hole 42, and a shoulder screw 59 is driven into the threaded hole 36 through the bushing 55. Therefore, the shoulder screws 57 and 59 tightened into the respective threaded holes 35 and 36 form with the bushings 56 and 58 and the holes 41 and 42 the pivot of the articulation 18 (FIG. 1).

In operation, the three tubes 45 will ensure transmission of pressurized air between the percussion drill and the control on the hand-grip member to enable control of the operation of the percussion drill by the worker. Sealing between the tubes 45 and the holes 38 and 52 is ensured by inflation of the tubes 45 when the air-leg of the percussion drill is supplied with pressurized air. As indicated in the foregoing description, with the small angular movement of, for example, ±5° between the arm members 27 and 30, the flexible plastic tubes 45 will bend without onset of material fatigue, even after a large number of bending cycles.

Also in operation, the resilient member 46 is compressed between the top flat face 50 of the arm member 27 and the inner face of the top wall 43, while the resilient member 47 is compressed between the bottom flat face 51 of the arm member 27 and the inner face of the top bottom wall 44. During small angular movements of the arm member 30 about the arm member 27, the stiffness of the resilient, for example elastomeric members 46 and 47 is linear. If the amplitude of the angular movements increases, the greater compression of the members 46 and 47 considerably increases their stiffness. Thanks to their non-linear behaviour, the resilient members 46 and 47 thus act both as vibration-damping insulators and flexible cushions intended to limit the angular movements of the arm member 30 about the arm member 27 for example to the above mentioned angular value of ±5°.

The shoulders 48 and 49 of the resilient members 46 and 47, located between the end flat face 37 and the internal end wall 53, retain the resilient members 46 and 47 in position between the top flat face 50 of the arm member 27 and the inner face of the top wall 43 and between the bottom flat face 51 of the arm member 27 and the inner face of the bottom wall 44, respectively.

The anti-vibratory handle 24 of FIG. 2 provides an effective and relatively simple suspension. This suspension may be very readily adapted to existing percussion drill, since the attachment cones on the arm members 27 and 30 can be identical to those of conventional handle models.

Figure 3:
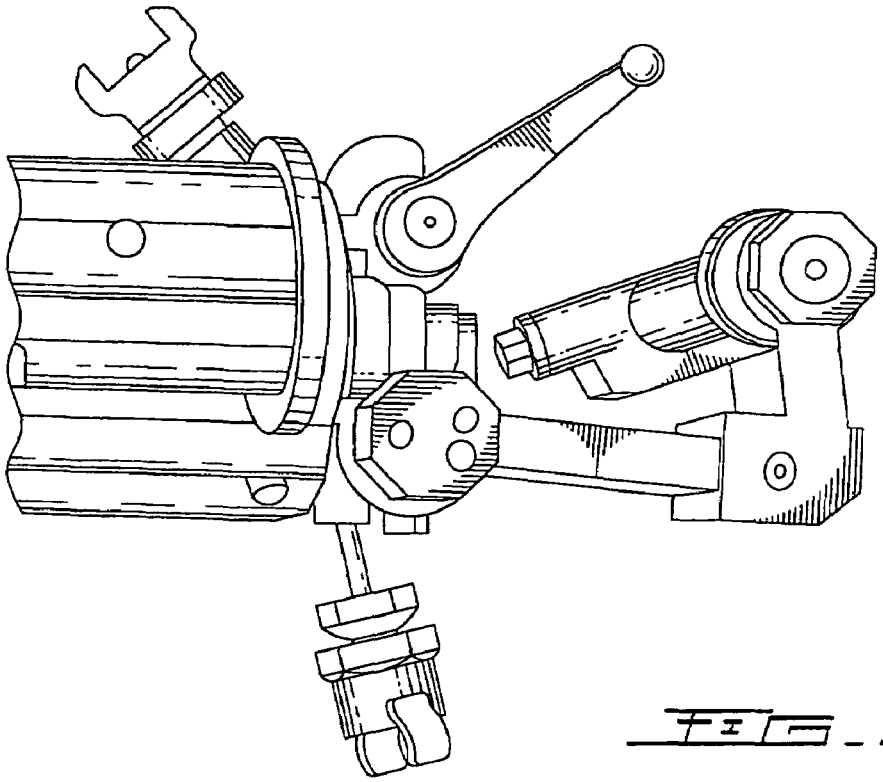
FIG. 3 is a side, perspective view of a JOY™ percussion drill on which an anti-vibratory handle as illustrated in FIG. 2 has been installed.
Figure 4:
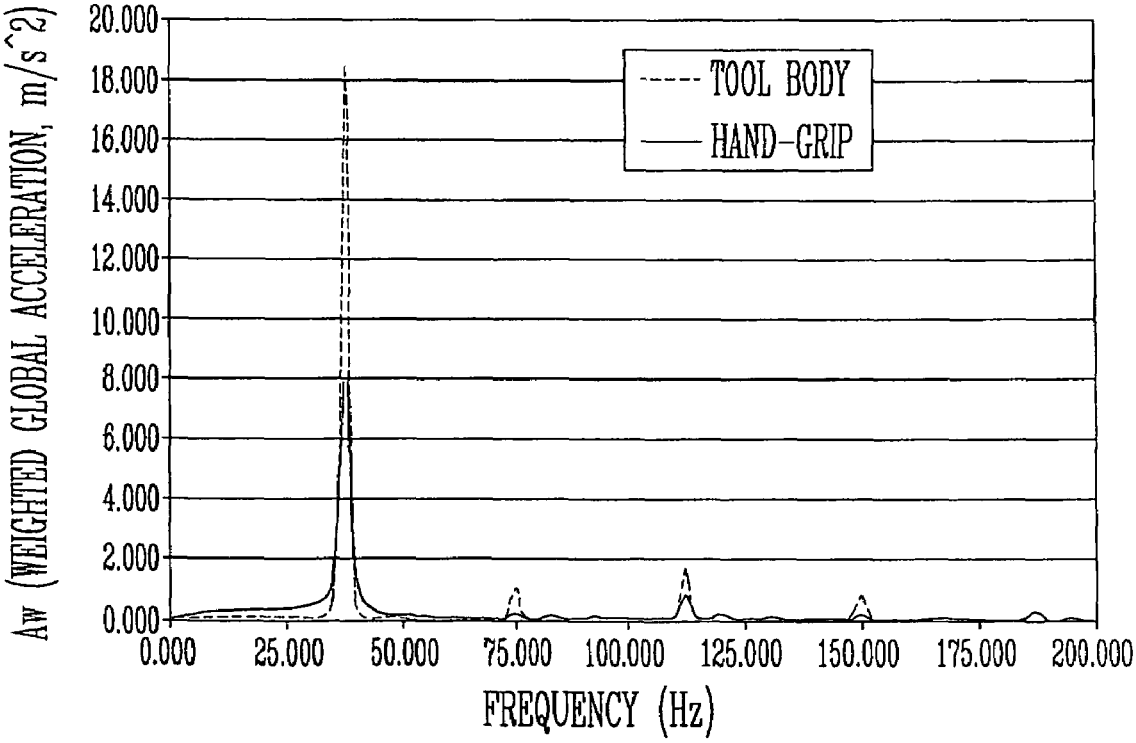
FIG. 4 is a graph of the weighted global acceleration "versus" the frequency of vibration showing a typical spectrum obtained during laboratory tests, with a triaxial accelerometer mounted on the handle at the level of the hang-grip member and two 0.635 mm thick and 12.7 mm wide resilient members made of neoprene duro 40, with strong gripping of the hand-grip member by the worker.

FIG. 3 illustrates the anti-vibratory handle 24 of FIG. 2 installed on a JOY™ percussion drill. The hand-grip portion of the handle remains at exactly the same height as on a conventional model, thus allowing access for the replacement of water tubes. Likewise, the worker finds the controls at exactly the same location as on the conventional handles.

Figure 5A:
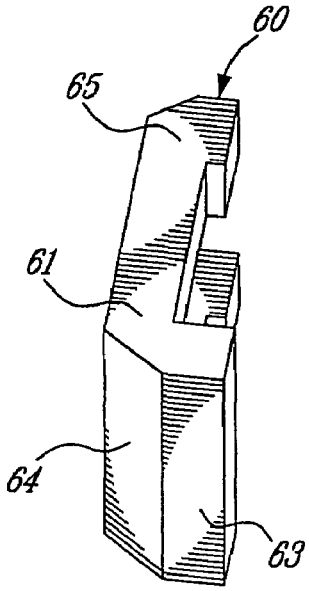
FIG. 5*a* is a side perspective view of a resilient member for use in the first illustrative embodiment of anti-vibratory handle of FIG. 2.
Figure 5B:
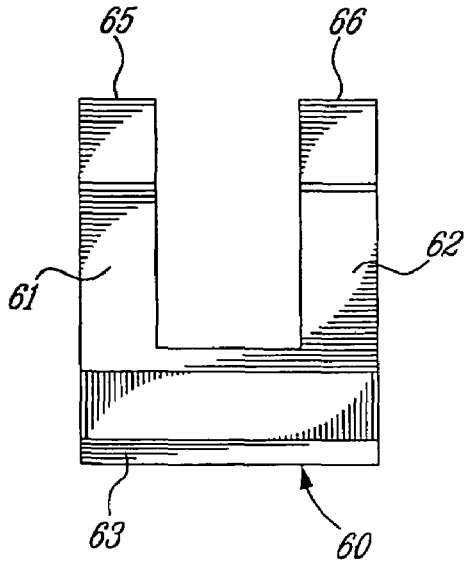
FIG. 5*b* is an underside elevational view of the resilient member of FIG. 5*a;*
Figure 6:
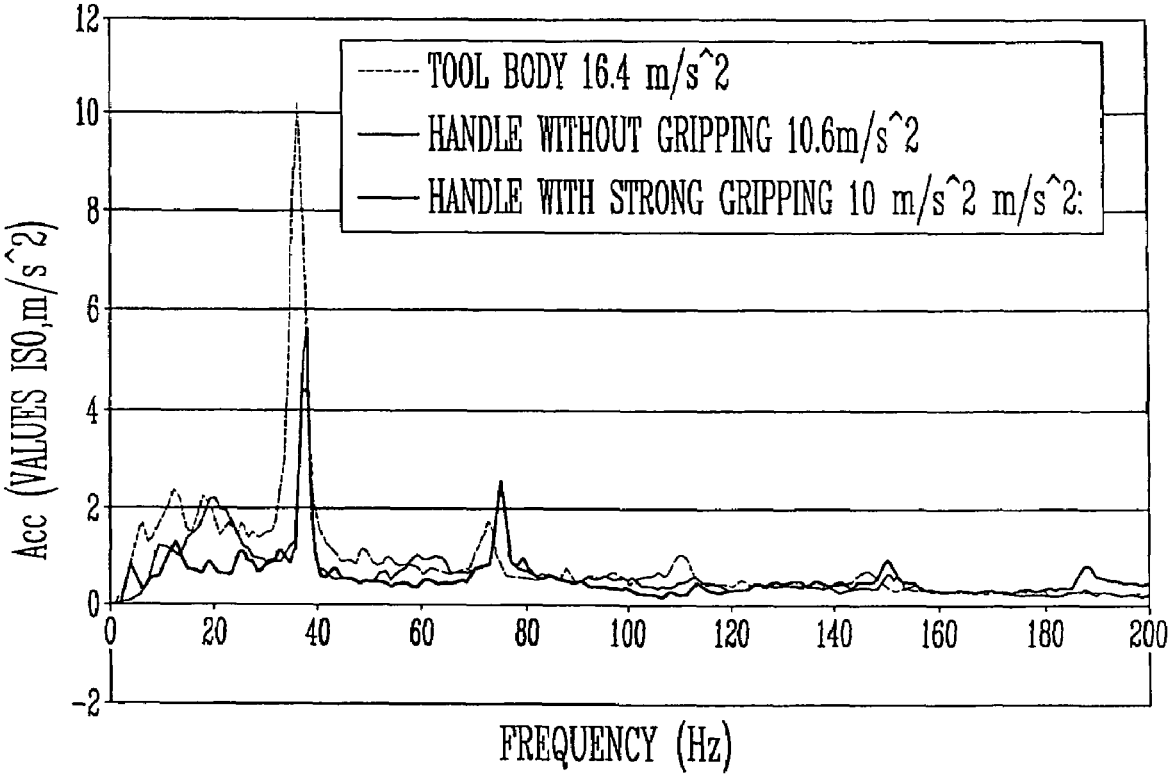
FIG. 6 is a graph of the acceleration "versus" the frequency of vibration showing a typical spectrum obtained during in-situ tests, with a triaxial accelerometer mounted on the handle at the level of the hand-grip member.

FIGS. 5*a* and 5*b* illustrates a resilient member 60 for use as resilient members 46 and 47 of FIG. 2. The resilient member 60 is L-shaped in cross section, defines two legs 61 and 62 and a shoulders 63, and is bevelled at 64. The shoulder 63 will, as explained in the foregoing description, keep the resilient member in place. The two legs 61 and 62 terminate in respective, thicker cushions 65 and 66. These cushions 65 and 66 keep the resilient member 60 compressed in the equilibrium position of the anti-vibratory handle 24 of FIG. 2. If the worker applies a significant pulling or pushing force on the anti-vibratory handle 24, the entire legs 61 and 62 are compressed between the box-like structure of the mobile portion 29 and the arm member 27 of the drill-mounted stationary portion 25. Under this condition, the suspension firms up and acts as a resilient bumper, limiting the pivoting movement of the anti-vibratory handle 24 about the shoulder screws 57 and 59. This concept provides at the same time good vibration insulation within the normal range of pulling and pushing forces applied to the anti-vibratory handle 24 and a still resilient bumper when an important pushing or pulling force is applied. It should be noted here that elastomers can withstand very heavy compression loads before showing permanent deformation.

It should be mentioned here that resilient members of other forms or nature can be used. For example, a torsion member can be used. This torsion member will be made of resilient material and interposed between the arm members 27 and 30. It is believed to be within the knowledge of those of ordinary skill in the art to design a torsional resilient member or other type of resilient member having the same function as the resilient members 46, 47 and 60.

Figure 7A:
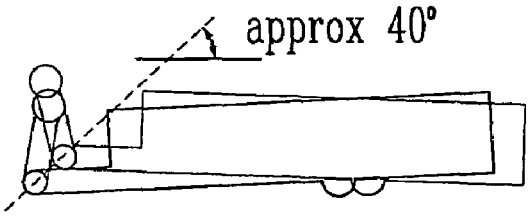
FIG. 7*a* is a schematic diagram illustrating the direction of movement of the anti-vibratory handle of FIG. 2 for a JOY™ percussion drill.
Figure 7B:
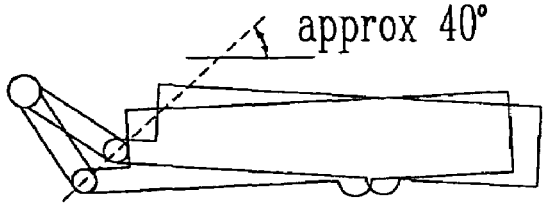
FIG. 7*b* is a schematic diagram showing an angle for an arm member of a mobile portion of the anti-vibratory handle according to the first illustrative embodiment of the present invention, optimized for the JOY™ percussion drill.

Analysis of high-speed filming showed that the movement of the handle attachment point is not parallel to the axis of percussion of the JOY™ drill but 40° apart from this axis of percussion as shown in FIGS. 7*a* and 7*b*. This is due to the center of gravity of the percussion drill not being situated in the axis of percussion, which brings about a slight rotational movement of the percussion drill about its point of attachment to the air-leg. FIGS. 7*a* and 7*b* show, in an amplified manner, the rotational movement of the percussion drill and the anti-vibratory handle.

FIG. 7*a* illustrates the situation for the case of the anti-vibratory handle 24 of FIGS. 2 and 3. This design has been optimized for a percussion drill in which the movement of the articulation 18 (FIG. 1) is parallel to the axis of percussion. Although this design is effective for a displacement of the articulation of the anti-vibratory handle parallel to the axis of percussion, it brings about a slight increase of the vibrations perpendicular to the axis of percussion. In order to address this problem, the solution illustrated in FIG. 7*b* was developed. By inclining the neutral position of the arm member 30 (FIG. 2) to an angle generally 90° apart from the direction of movement of the articulation 18, it is possible to compensate for the vibrations perpendicular to the axis of percussion.

Figure 8A:
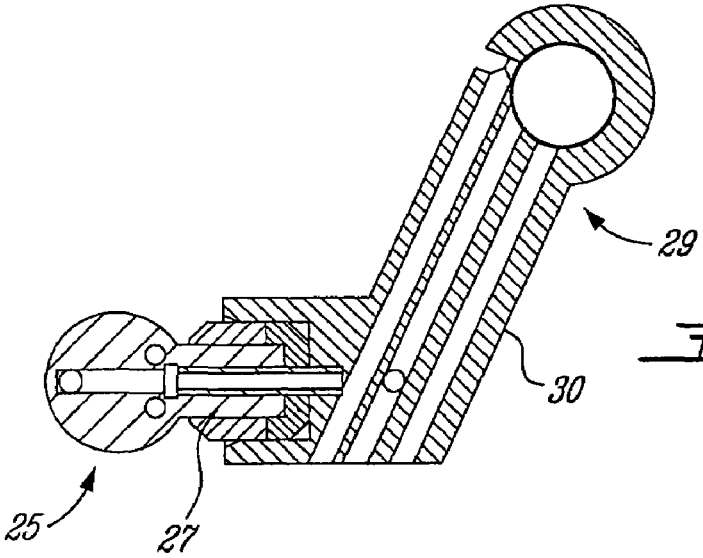
FIG. 8*a* is a cross sectional, side elevational view of the anti-vibratory handle according to the first non-restrictive illustrative embodiment of the present invention, optimized for the JOY™ percussion drill.
Figure 8B:
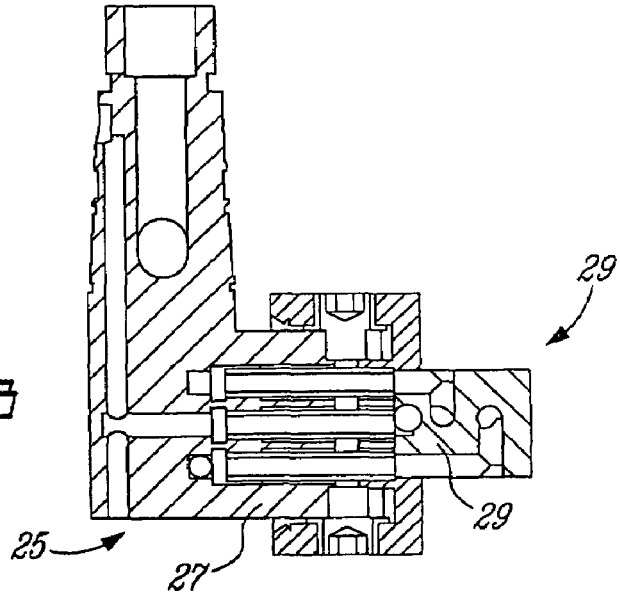
FIG. 8*b* is a cross sectional, top plan view of the anti-vibratory handle according to first the non-restrictive illustrative embodiment of the present invention, optimized for the JOY™ percussion drill.
Figure 9:
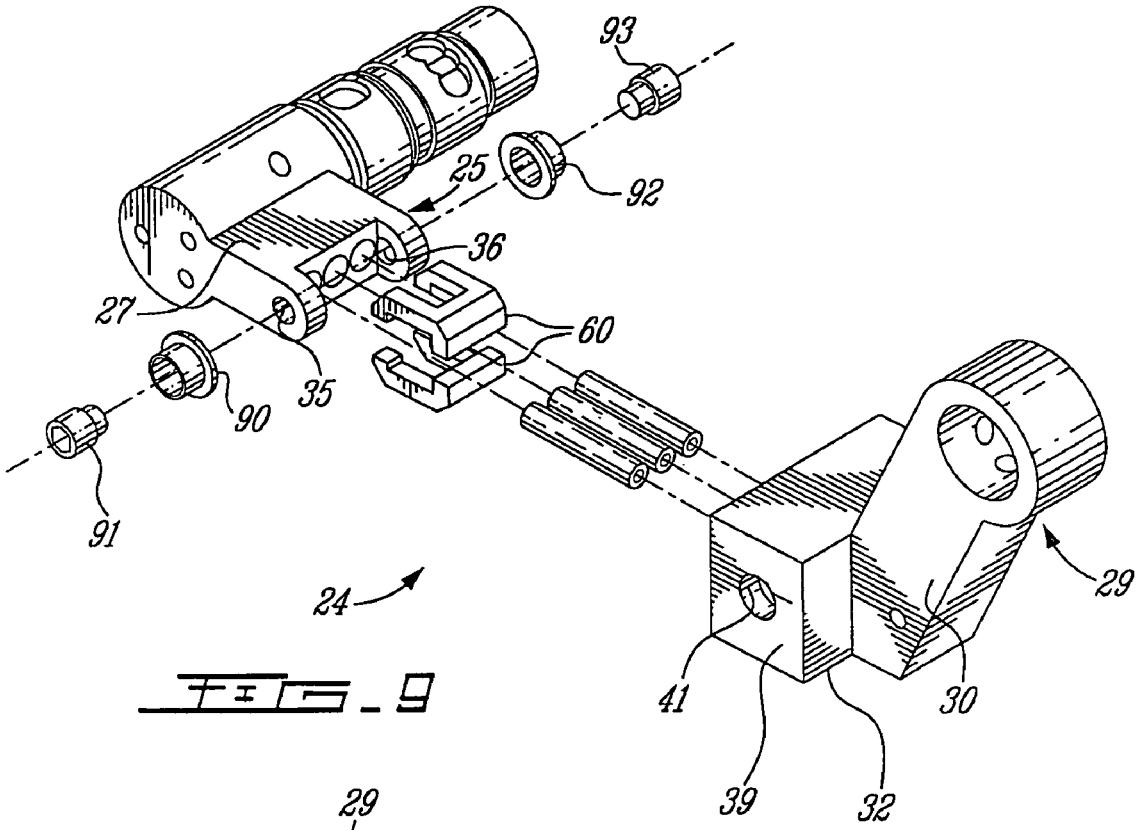
FIG. 9 is an exploded, three-dimensional perspective view of the anti-vibratory handle of FIGS. 8*a* and 8*b;*

FIGS. 8*a* and 8*b* are cross sectional, side elevational and top plan views of the anti-vibratory handle 24 optimized for the JOY™ percussion drill, while FIG. 9 is an exploded, three-dimensional perspective view of this handle.

The differences between the anti-vibratory handle of FIGS. 8 and 9 with respect to the anti-vibratory handle of FIG. 2 are the following:

- the neutral angle of the arm member 30 has been adjusted to absorb vertical as well as horizontal vibrations produced by a JOY™ percussion drill (see FIG. 7*b*);
- the arm member 27 of the stationary portion 25 of the handle 24 is not only wider but has been shortened in order to position the hand-grip member of the anti-vibratory handle 24 at the same position as the hand-grip member of the original handle of the JOY™ percussion drill. The dimensions of the box-like structure of the mobile portion 29 of the anti-vibratory handle 24 has been modified to receive the modified arm member 27;
- the anti-vibratory handle 24 of FIGS. 8 and 9 uses the resilient member of FIGS. 5*a* and 5*b* as resilient members 46 and 47 (FIG. 2);
- hole 41 is wider to receive a bushing 90 from the inside of the box-like structure 32 of the mobile portion 29. An embedded screw 91 is driven into the threaded hole 35 through the bushing 90 to form a more robust pivot. Screw 91 is confined in hole 41 and does not protrude from wall 39 of the box-like structure of the mobile portion 29;
- hole 42 (FIG. 2) is wider to receive a bushing 92 from the inside of the box-like structure 32 of the mobile portion 29. An embedded screw 93 is driven into the threaded hole 36 through the bushing 92 to form a more robust pivot. Screw 93 is confined in hole 42 and does not protrude from wall 40 (FIG. 2) of the box-like structure of the mobile portion 29;

the suspended mass of the mobile portion 29 has been increased by 720 grams (2930 g compared to 2210 g for the anti-vibratory handle 24 of FIG. 2), allowing for further reduction of the vibration levels; and air ducts of wider diameter, allowing faster response of the air-leg.

The resulting anti-vibratory handle 24 of FIGS. 8*a*, 8*b* and 9 is easier to machine and possesses a greater robustness.

Figure 10:
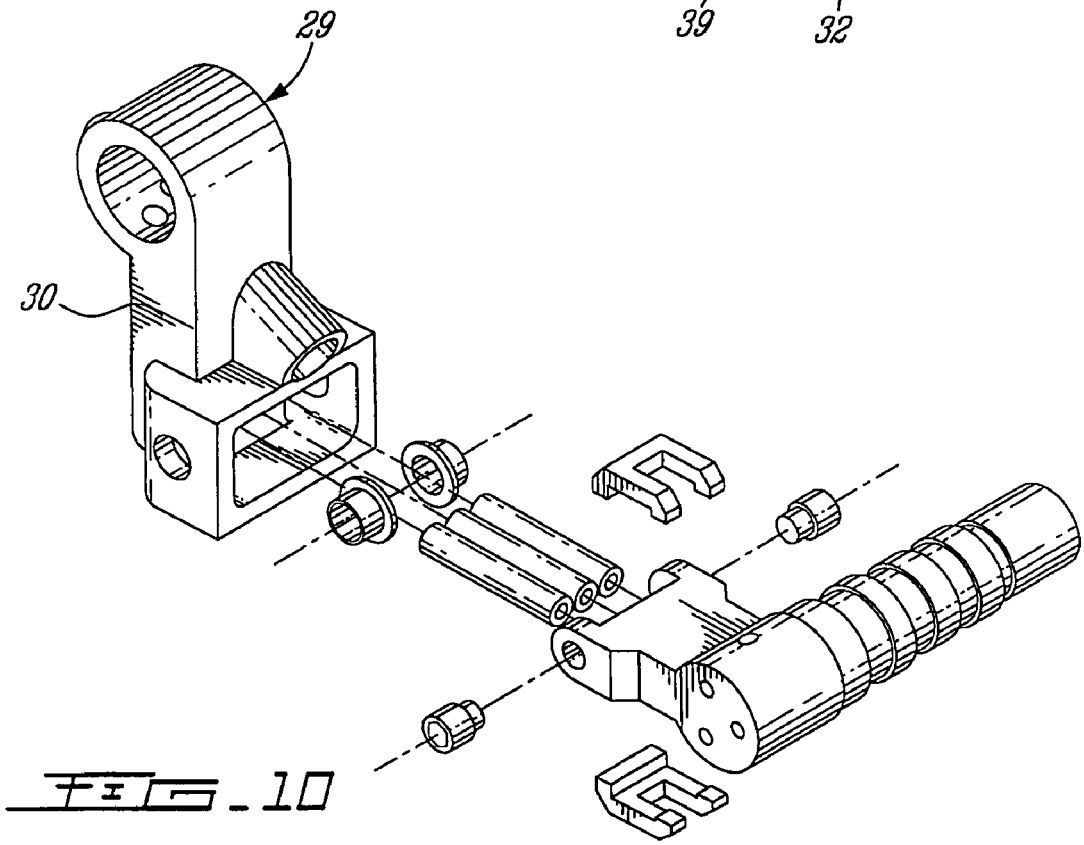
FIG. 10 is an exploded, three-dimensional perspective view of an anti-vibratory handle according to the first non-restrictive illustrative embodiment of the present invention, optimized for a SECAN™ percussion drill.

FIG. 10 illustrates an anti-vibratory handle 24 optimized for a SECAN™ percussion drill.

The main difference between the original handles of SECAN™ and JOY™ percussion drills is the presence of a push-button valve on the hand-grip member.

As it was the case for the JOY™ percussion drill, the angle of movement of the hand-grip member was examined using a high-speed camera in order to optimize the design by maximizing the absorption of vibrations perpendicular to the axis of percussion. In the case of the SECAN™ percussion drill, the angle of movement is smaller than for JOY™ percussion drills, having a value of about 15°.

The anti-vibratory handle of FIG. 10, optimized for SECAN™ percussion drills, presents the following differences with the anti-vibratory handle of FIGS. 8*a*, 8*b* and 9, optimized for JOY™ percussion drills:

the hand-grip portion of the air-leg quick retraction valve (it should be noted that the valve used is the same as for the original rigid handle);

the neutral angle of the arm member 30 is perpendicular to the 15° angle of movement of the SECAN™ percussion drill;

the suspended mass of the mobile portion 29 is the same as that of the anti-vibratory handle 24 of FIGS. 8*a*, 8*b* and 9; and the total added mass is 630 g.

Figure 11:
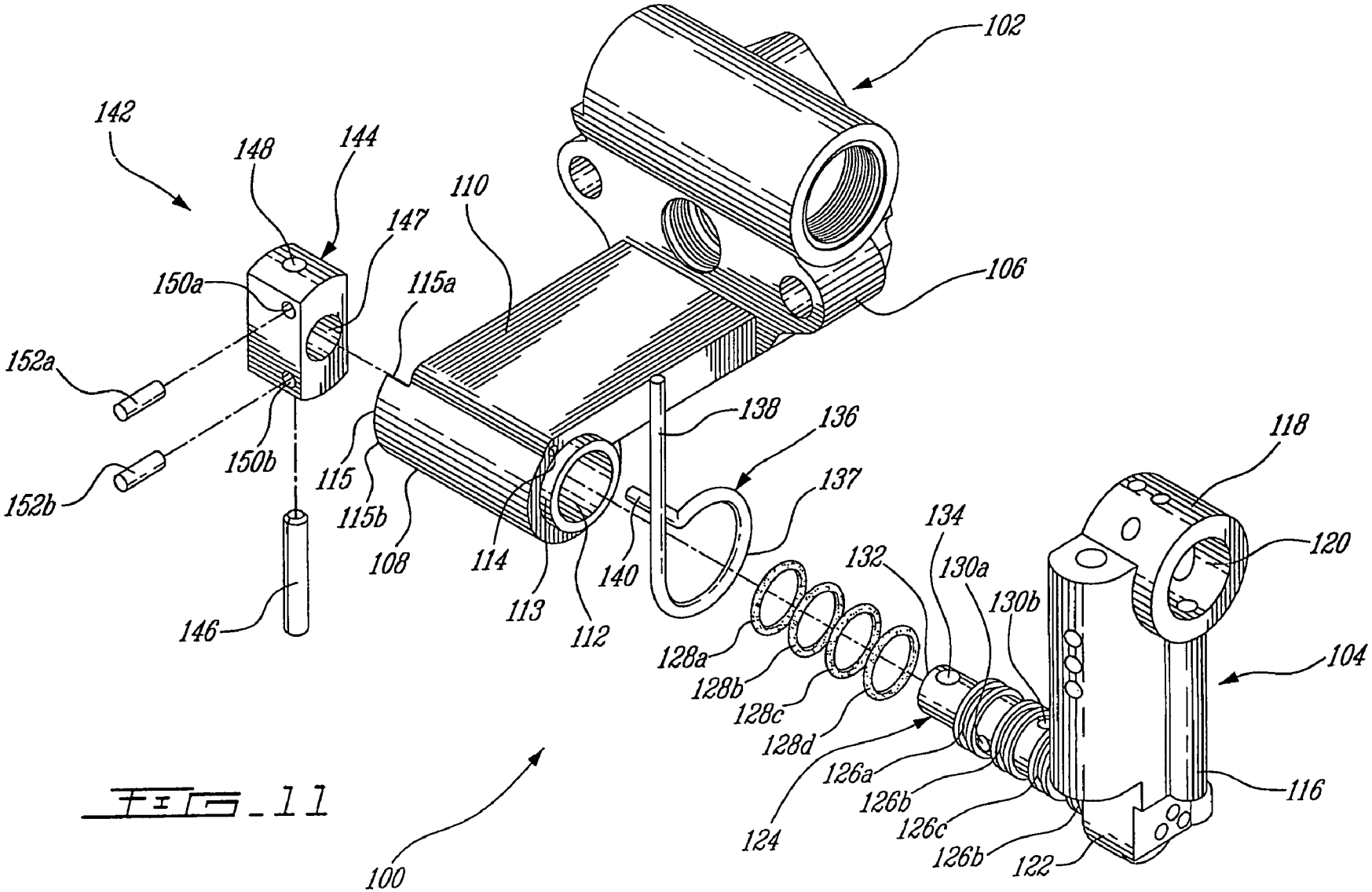
FIG. 11 is a first exploded perspective view of an anti-vibratory handle according to a second non-restrictive illustrative embodiment of the present invention.
Figure 12:
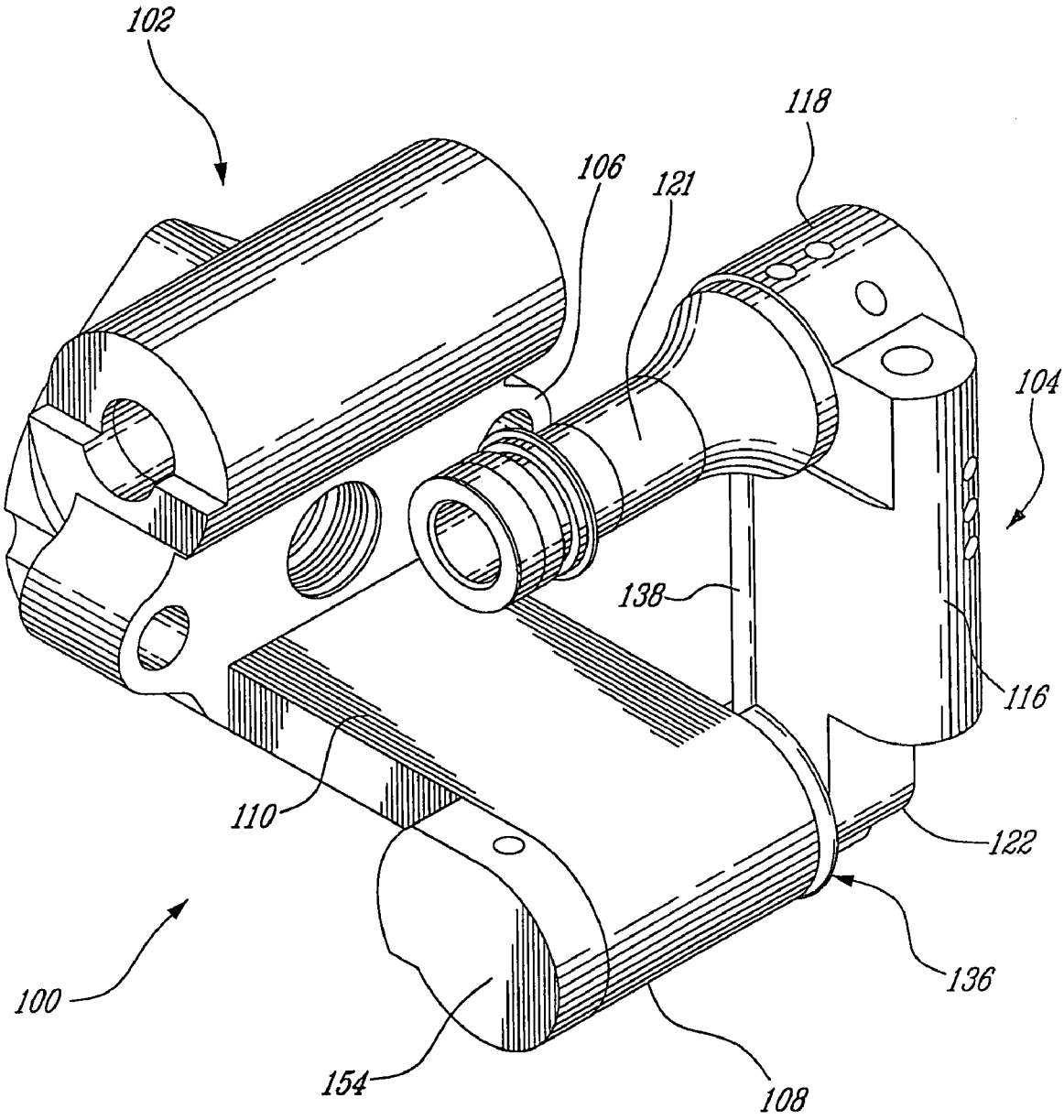
FIG. 12 is a perspective view of the assembled anti-vibratory handle of FIG. 11.
Figure 13:
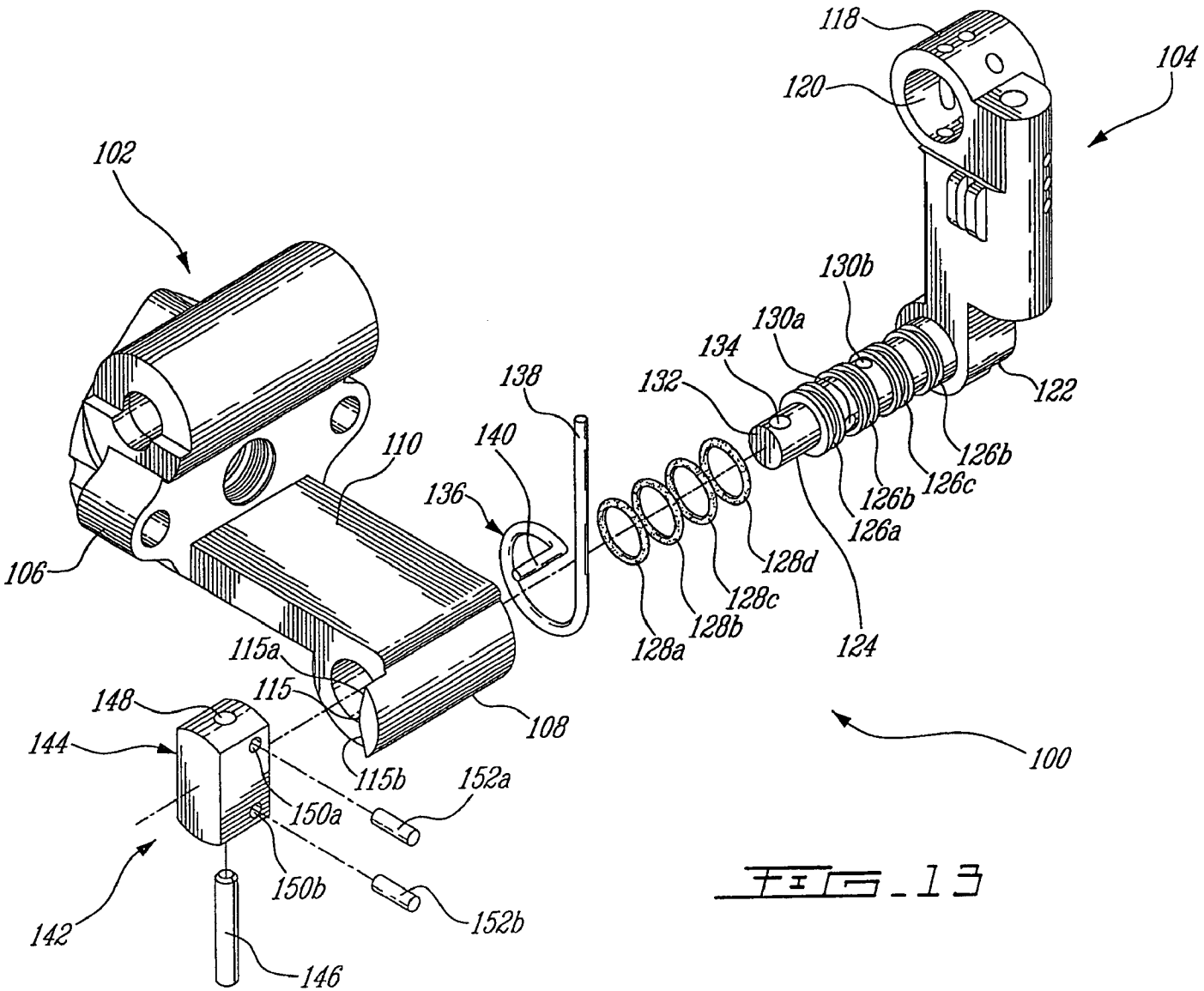
FIG. 13 is second exploded perspective view of the anti-vibratory handle of FIG. 11, according to the second non-restrictive illustrative embodiment of the present invention.

Turning now to FIGS. 11 and 12 of the appended drawings, an anti-vibratory handle 100 according to a second non restrictive, illustrative embodiment of the present invention will be described. It should be noted that for concision purposes, only the differences between the anti-vibratory handle 100 and the anti-vibratory handle 24 described in the foregoing description will be discussed herein below.

Generally stated, the principle of operation of the anti-vibratory handle 100 is similar to the principle of operation of the anti-vibratory handle 24 described in the foregoing description.

Referring now to FIGS. 11 and 12, the anti-vibratory handle 100 includes a stationary portion 102 and a mobile portion 104. The stationary portion 102 is provided with a proximal end comprising a fixation cone 106 of the same type as those used for mounting the conventional handle to the tool (not shown) producing vibrations. Instead of mounting the stationary portion 102 on the anti-vibratory handle 100 through the fixation cone 106 and a conical adaptor located on the back part of the percussion drill, it is also possible to modify the back part of the percussion drill to include the stationary portion 102 (adaptor flange) of the anti-vibratory handle 100. The stationary portion 102 also comprises a distal end 108 forming part of the pivot assembly of the handle 100.

As non limitative example, the fixation cone 106 or, alternatively, the adaptor flange of the modified back part of the percussion drill 102 can be designed to fit on the above mentioned JOY™ and SECAN™ percussion drills.

The stationary portion 102 comprises an arm member 110 interconnecting the proximal end (fixation cone 106) to the distal end 108. The arm member 110 includes a first set of three conduits (not shown) to connect the pressurized air controls located on the mobile portion 104 of the handle 100 with the percussion drill, to thereby supply the tool with pressured air.

The proximal end 108 defines a shaft-receiving barrel 112 and a small hole 114 on the periphery of the barrel 112 at one open end thereof. At the same open end of the shaft-receiving barrel 112 is defined an annular shoulder 113. The end of the shaft-receiving barrel 112 opposite to the annular shoulder 113 defines a semicircular extension 115.

The mobile portion 104 includes an arm member 116. The arm member 116 comprises a distal end 118 defining an attachment device 120 of the type providing for direct attachment of a conventional hand-grip member 121 (FIG. 12) to including controls (not shown) for the operation of the tool producing vibrations. The arm member 116 has a proximal end 122 provided with a shaft 124 having a size and configuration for insertion into the shaft-receiving barrel 112. The shaft 124 comprises four laterally adjacent annular grooves 126*a*-126*d* designed to accommodate four O-rings 128*a*-128*d*, respectively. Three apertures 130*a*-130*c* (130*c* not shown) are formed on the shaft 124 and are respectively located between the three pairs of adjacent annular grooves 126*a*-126*d*. The three apertures 130 respectively lead to three pressurized air conduits of a second set of conduits (not shown) formed in the shaft 124 and extending through the arm member 116. Each pressurized air conduit of the second set is intended to be connected with a corresponding pressurized air conduit of the first set of conduits in the arm member 110 to connect the pressurized air controls located on the mobile portion 104 of the handle 100 with the percussive drill, i.e. to supply the tool producing vibrations with pressurized air. When the shaft 124 is mounted in the shaft-receiving barrel 112, the three pairs of adjacent O-rings 128*a*-128*d*, positioned in their respective annular grooves 126, respectively define in the barrel 112 three air-tight chambers adapted to interconnect the first pressurized air conduit of the first set with the first pressurized air conduit of the second set through the aperture 130*a*, the second pressurized air conduit of the first set with the second pressurized air conduit of the second set through the aperture 130*b*, and the third pressurized air conduit of the first set with the third pressurized air conduit of the second set through the aperture 130*c*. At the same time, the O-rings 128*a*-128*d* will (a) allow the shaft 124 to rotate in the barrel 112 and therefore the mobile portion 104 to pivot relative to the stationary portion 102 about the longitudinal axis of the shaft-receiving barrel 112, and (b) to maintain a permanent connection between the first set of three pressurized air conduits and the second set of three pressurized conduits. In this manner, supply of pressurized air to the tool through the first set of conduit, the barrel 112 and the second set of conduits can be controlled at the hand-grip member 121 in the same manner as when the tool is equipped with its conventional hand-grip member.

The shaft 124 includes a distal end 132 having a reduced diameter and comprising a transversal hole 134. When the anti-vibratory handle 100 is assembled, the distal end 132 is inserted in an aperture of reduced diameter (not shown) at the end of the barrel 112 opposite the shoulder 113.

A lock assembly 142 includes a block 144 and a locking pin 146 and is mounted on the distal end 132 on the end of the barrel 112 opposite to the shoulder 113. The block 144 comprises a first opening 147 destined to accommodate the distal end 132 of the shaft 124, a second opening 148 destined to accommodate the locking pin 146, and two hollows 150*a* and 150*b* destined to receive respectively two pins 152*a* and 152*b*, each of which has the function of a stopper abutting against respective sides 115*a* and 115*b* of the semicircular extension 115.

A torsion spring 136 comprising a longer end portion 138, an intermediate ring-shaped portion 137 and a shorter end portion 140 is interposed between the stationary portion 102 and the mobile portion 104 of the anti-vibratory handle 100. When the anti-vibratory handle 100 is assembled:

- the ring-shaped portion 137 of the torsion spring 136 is looped around the annular shoulder 113;
- the shorter end portion 140 of the torsion spring 136 is inserted into the hole 114; and
- the longer end portion 138 extends parallel to the arm member 116 and leans against this arm member 116, and the free end tip of the longer end portion 138 is inserted in a hole (not shown) of the conical attachment device 120 at the distal end of the arm member 116.

To assemble the anti-vibratory handle 100, the following operations are performed:

- each of the four O-rings 128*a*-128*d* are respectively positioned in the respective annular groove 126*a*-126*d* of the shaft 124;
- the shorter portion 140 of the torsion spring 136 is positioned in the small hole 114 and the mobile portion 104 is attached to the stationary portion 102 by inserting the shaft 124 into the shaft-receiving barrel 112;
- the free end tip of the longer portion 138 of the torsion spring 136 is inserted in the hole (not shown) of the attachment device 120;
- the shaft 124 is positioned into shaft-receiving barrel 112, so that the distal end 132 of the shaft 124 protrudes out of the shaft-receiving barrel on the side opposite to that where the torsion spring 136 is mounted;
- the mobile portion 104 is fixed by inserting the distal end 132 into the opening 147 of the block 144 and by inserting the locking pin 146 into both the opening 148 of the block 144 and the hole 134 of the distal end 132 of the shaft 124; and
- the two pins 152 are respectively inserted into the two holes 150*a* and 150*b* to abut against the respective sides 115*a* and 115*b* of the semicircular extension 115.

When the anti-vibratory handle 100 undergoes vibrations under the effect of the tool producing vibrations, the mobile portion 104 pivots about the longitudinal axis of the shaft-receiving barrel 112. The torsion spring 136 then acts as a resilient member, the spring constant of the torsion spring 136 creating a restoring force that drives the mobile portion 104 back to its rest position relative to the stationary portion 102. The two pins 152, in cooperation with the sides 115*a* and 115*b* of the semicircular extension 115, restrict the amplitude of the angular movement of the mobile portion 104 from its rest position by abutting against the respective sides 115*a* and 115*b* of the semicircular extension 115.

The above described second illustrative embodiment of anti-vibratory handle 100 using a torsion spring and O-rings has been developed for SECAN™ percussion drill but can be adapted to JOY™ drills by modifying the adaptor flange of the stationary portion 102. The following results have been obtained with prototypes using the embodiment of FIG. 12:

- an attenuation of vibrations of 85% in the percussive axis according to ISO-5349 standard;
- an overall attenuation of 60% according to ISO-5349 standard.

Although the present invention has been described hereinabove by way of non-restrictive illustrative embodiments thereof, these embodiments can be modified at will, within the scope of the appended claims, without departing from the nature and spirit of the subject invention. For example, it should be understood that the anti-vibratory handle according to the non-restrictive illustrative embodiments of the present invention can be optimized for every type of percussion drill or other tool producing vibrations.

What is claimed is:

1. An anti-vibratory handle for installation on a percussion drill supplied with a pressurized fluid and producing vibrations in the direction of an axis of reciprocation of the percussion drill, the anti-vibratory handle comprising:

- a stationary portion for being mounted to a body of the percussion drill and comprising a distal end;
- a mobile portion comprising a proximal end, wherein one of the distal end of the stationary portion and the proximal end of the mobile portion is provided with a shaft receiving barrel defining a pivot axis generally perpendicular to the axis of reciprocation of the percussion drill, wherein the other of the distal end of the stationary portion and the proximal end of the mobile portion includes a shaft for insertion in the shaft receiving barrel, and wherein the mobile portion comprises an arm member generally perpendicular to the pivot axis and a distal end including a hand-grip member so mounted to the arm member as to be generally parallel to the pivot axis but spaced apart therefrom; the shaft and shaft receiving barrel defining an articulation between the stationary and mobile portions allowing the mobile portion to pivot about the pivot axis with respect to the stationary portion;
- a control of the operation of the percussion drill mounted on the hand-grip member;
- a resilient vibration-damping assembly interposed between the distal end of the stationary portion and the proximal end of the mobile portion to avoid transmission of vibrations through the articulation; and
- at least one conduit for transmitting pressurized fluid between the percussion drill and the percussion drill operation control to allow the percussion drill to be operated through said percussion drill operation control, the at least one conduit extending through the stationary portion, the distal end of the stationary portion, the assembly comprising the shaft receiving barrel and the shaft inserted in the shaft receiving barrel, the proximal end of the mobile portion, the arm member of the mobile portion and the mobile portion.

2. An anti-vibratory handle as defined in claim 1, wherein:

- the shaft comprises a distal end portion protruding out of one end of the shaft-receiving barrel when the shaft is inserted in the shaft-receiving barrel; and
- the anti-vibratory handle comprises a lock assembly mounted to the distal end portion of the shaft in order to lock the shaft in the shaft-receiving barrel.

3. An anti-vibratory handle as defined in claim 2, wherein:

- the lock assembly comprises a block with (i) a first opening to receive the distal end portion of the shaft and (ii) a second opening;
- the distal end portion of the shaft comprises a hole;
- the lock assembly comprises a locking pin to extend through the second opening of the block and the hole of the distal end portion of the shaft.

4. An anti-vibratory handle as defined in claim 3, wherein:

- the shaft receiving barrel comprises abutting members; and
- the lock assembly comprises pins mounted on the block of the lock assembly and abutting against the abutting members to limit the amplitude of a pivotal movement of the shaft in the barrel.

5. An anti-vibratory handle as defined in claim 1, wherein: the stationary portion comprises an arm member extending parallel to the axis of reciprocation of the tool and spacing the assembly comprising the shaft receiving barrel and the shaft inserted in the shaft receiving barrel from the body of the percussion drill.

6. An anti-vibratory handle as defined in claim 5, wherein: the arm member of the stationary portion comprises a proximal end adapted to be fixedly connected to the body of the percussion drill, and a distal end defining the distal end of the stationary portion.

7. An anti-vibratory handle as defined in claim 1, wherein the at least one pressurized fluid conduit comprises:

at least two annular grooves in the shaft;

at least two O-rings positioned in said at least two annular grooves, respectively, to define a fluid-tight chamber in the barrel when the shaft is inserted in said barrel;

at least one first pressurized fluid conduit formed in the stationary portion and opening into the fluid-tight chamber in the barrel; and at least one second pressurized fluid conduit formed in the mobile portion and also opening into the fluid-tight chamber in the barrel;

whereby, in operation, the at least one first pressurized fluid conduit is connected with the at least one second pressurized fluid conduit through the fluid-tight chamber in the barrel.

8. An anti-vibratory handle as defined in claim 7, wherein the pressurized fluid is a pressurized gas.

9. An anti-vibratory handle as defined in claim 1, wherein the resilient vibration-damping assembly comprises a torsion spring interposed between the stationary portion and the mobile portion.

10. An anti-vibratory handle as defined in claim 9, wherein the torsion spring comprises an intermediate ring shaped portion disposed on the shaft, a first end portion attached to the shaft-receiving barrel and a second end portion attached to said other of the distal end of the stationary portion and the proximal end of the mobile portion.

11. An anti-vibratory handle as defined in claim 1, wherein the resilient vibration-damping assembly comprises a resilient torsion member interposed between the stationary and mobile portions.

12. An anti-vibratory handle as defined in claim 1, wherein the at least one pressurized fluid conduit comprises:

a plurality of annular grooves in the shaft;

a plurality of O-rings positioned in the annular grooves, respectively, to define fluid-tight chambers in the shaft receiving barrel when the shaft is inserted in the shaft-receiving barrel;

first pressurized fluid conduits formed in the stationary portion and opening into respective ones of the fluid-tight chambers in the shaft-receiving barrel; and second pressurized fluid conduits formed in the mobile portion and also opening into respective ones of the fluid-tight chambers in the shaft receiving barrel;

whereby, in operation, each of the first pressurized fluid conduits is connected with a respective one of the second pressurized fluid conduits through a respective fluid-tight chamber in the shaft-receiving barrel.

* * * * *